US006158534A

United States Patent [19]

Fanuel

[11] Patent Number: 6,158,534

[45] Date of Patent: Dec. 12, 2000

[54] CORE SAMPLER

[75] Inventor: Philippe Fanuel, Brussels, Belgium

[73] Assignee: Baroid Technology, Inc., Houston, Tex.

[21] Appl. No.: 09/101,488

[22] PCT Filed: Jan. 14, 1997

[86] PCT No.: PCT/BE97/00003

§ 371 Date: Jul. 14, 1998

§ 102(e) Date: Jul. 14, 1998

[87] PCT Pub. No.: WO97/26438

PCT Pub. Date: Jul. 24, 1997

[30] Foreign Application Priority Data

Jan. 15, 1996 [BE] Belgium ..... 9600030

[51] Int. Cl.[7] ..... E21B 10/02

[52] U.S. Cl. ..... 175/403; 175/404

[58] Field of Search ..... 175/403, 404, 175/332, 333

[56] References Cited

U.S. PATENT DOCUMENTS

| | | | |
|---|---|---|---|
| 1,614,199 | 1/1927 | Jones et al. . | |
| 1,834,320 | 12/1931 | Suman . | |
| 2,134,886 | 11/1938 | Oliver . | |
| 2,147,896 | 2/1939 | Harrington . | |
| 2,189,057 | 2/1940 | Copelin | 175/404 |
| 2,658,726 | 11/1953 | Stokes . | |
| 2,713,473 | 7/1955 | Talbot . | |
| 3,833,074 | 9/1974 | Courtois . | |
| 4,466,497 | 8/1984 | Soinski et al. | 175/246 |

FOREIGN PATENT DOCUMENTS

| | | |
|---|---|---|
| 0198406 | 10/1986 | European Pat. Off. . |
| 2169708 | 9/1973 | France . |
| 1634490 | 8/1970 | Germany . |
| 1222526 | 2/1971 | United Kingdom . |

*Primary Examiner*—Thomas B. Will
*Assistant Examiner*—Meredith Petravick
*Attorney, Agent, or Firm*—Browning Bushman

[57] ABSTRACT

A core sampler, particularly for oil prospecting, including a coring bit (2), an outer barrel (3) for rotating the coring bit (2), and an inner barrel (5) for receiving the core sample (7) in its internal space (8) during coring, the inner (5) and outer (3) barrels being substantially coaxial, and further comprising an intermediate barrel (15) coaxially arranged between the inner (5) and outer (3) barrels and defining a first longitudinal coring fluid channel (16) with the outer barrel (3), and a second longitudinal coring fluid channel (17) with the inner barrel (5), as well as said longitudinal channels (16, 17) and valving for at least temporarily selectively causing and/or cutting off coring fluid communication between the rear end (17B) of the second longitudinal channel (17) and/or the rear end (16B) of the first longitudinal channel (16) and/or the rear end (8B) of the internal space (8).

39 Claims, 5 Drawing Sheets

CORE SAMPLER

This application claims the benefit of International Application PCT/BE 97/00003 having a priority date of Jan. 5, 1996.

SUMMARY OF THE INVENTION

The present invention relates to a core sampler, particularly for oil prospecting, comprising:

a coring bit, an outer barrel for rotating the coring bit, and an inner barrel for receiving a core sample in its interior space during core sampling, the inner barrel and outer barrel being substantially coaxial.

The annular space between the inner barrel and outer barrel is used to convey a core-sampling fluid toward the interior space of the inner barrel and/or toward nozzles of the bit.

There is a need to be able to convey this fluid and/or another coring fluid in a controlled way toward or from this interior space or alternatively toward a particular device of the core sampler, possibly so that each of the coring fluids is controlled independently.

Surprisingly, in order to solve this problem, it has proved highly advantageous to provide, according to the invention, within a core sampler of the aforementioned type:

a middle barrel arranged coaxially between the inner barrel and the outer barrel and delimiting, on the one hand with the outer barrel, a first longitudinal channel for a core-sampling fluid and, on the other hand, with the inner barrel, a second longitudinal channel for a core-sampling fluid, the longitudinal channels and the interior space each having a front end close to the coring bit and a rear end remote from this bit, and means which selectively, and at least temporarily, provide and/or block a coring-fluid communication between the rear end of the second longitudinal channel and/or that of the first longitudinal channel and/or that of the interior space.

As a preference, according to the invention, the aforementioned selective means at least temporarily place in fluid communication a duct for supplying a coring fluid from a reservoir on the surface and nozzles of the bit, via the first longitudinal channel and, advantageously, the selective means at least temporarily place in fluid communication the rear end of the aforementioned interior space and the duct for supplying fluid.

According to one advantageous embodiment of the invention, the selective means comprise a controlled valve designed to selectively block a flow of fluid from the supply duct toward the interior space and so as possibly to allow a flow from this space toward the supply duct, if appropriate toward the first longitudinal channel.

According to another particularly advantageous embodiment of the invention, the selective means at least temporarily provide a fluid communication between the supply duct and the second longitudinal channel, and comprise an auxiliary controlled valve designed to selectively block a flow of fluid from the supply duct toward the first longitudinal channel.

According to yet another embodiment of the invention, the selective means place in fluid communication, via their rear ends, the interior space and the second longitudinal channel, a piston is mounted in the inner barrel so that it can be pushed, from practically the front end of the interior space toward the rear end thereof, by a core sample which is being formed, and a coring fluid is housed in the inner barrel, at least between the piston and the rear end of the interior space.

Depending on the particular application for which the core sampler of the invention is intended, it may be preferable that either the outer barrel and the middle barrel are mounted in such a way that they can rotate independently of one another about their common longitudinal axis and the inner barrel is then mounted so that it is unable to move, at least in terms of rotation, with respect to the middle barrel, or the outer barrel and the middle barrel are mounted so that they are stationary with respect to one another, at least as far as their rotation about their common longitudinal axis is concerned, and the middle barrel and the inner barrel are then mounted so that they can rotate independently of one another about their common longitudinal axis.

Other details and particular features of the invention will emerge from the secondary claims and from the description of the drawings which are appended to this text and which illustrate, by way of nonlimiting examples, some advantageous embodiments of the invention.

DETAILED DESCRIPTION OF THE PREFERRED EMBODIMENTS

Figure 1:
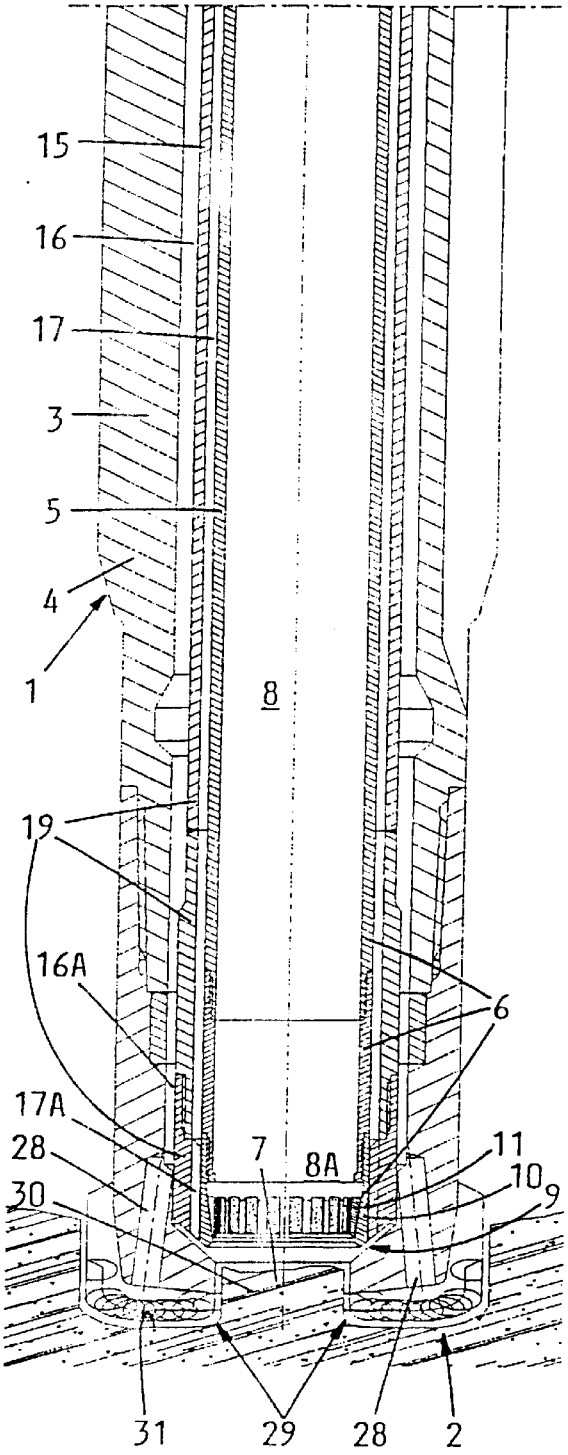
FIG. 1 depicts diagrammatically, in longitudinal section, with cutaway, a front end of a core sampler according to one embodiment of the invention.

In the various figures, the same reference notation denotes identical or analogous elements.

The core sampler 1 (FIGS. 1 and 2) of the invention, intended in particular for oil prospecting, comprises a coring bit 2, an outer barrel 3, which may be formed of several sections 4 screwed into one another and to the bit 2 and which serves, among other things, for rotating the latter, and an inner barrel 5, which may also be made up of several sections 6 for receiving a core sample 7 in its interior space 8 during the core-sampling operation. The inner barrel 5 and the outer barrel 3 are substantially coaxial. The inner barrel 5 comprises, for example, at its front end 9 (when considering the direction of travel of the core sampler 1 as it cuts a core sample 7), a known system 10 with split frustoconical ring 11 for holding close to its base a core sample 7 in the interior space 8 while the inner barrel 5 or the core sampler 1 is being raised back up toward the surface.

The core sampler 1 of the invention additionally comprises a middle barrel 15 arranged coaxially between the inner barrel 5 and the outer barrel 3 and delimiting with the latter a first annular longitudinal channel 16 for a core-sampling fluid and, with the inner barrel 5, a second longitudinal channel 17 for a coring fluid. The first longitudinal channel 16 has a front end 16A close to the bit 2 and a rear end 16B remote from the bit 2. Using the same reference frame that the bit 2 constitutes, the second longitudinal channel 17 has a front end 17A and a rear end 17B, and the interior space 8 has a front end 8A and a rear end 8B.

The core sampler 1 of the invention additionally comprises means 18 which selectively and at least temporarily, preferably in a controlled way, produce and/or block a coring-fluid communication between the rear end 17B of the second longitudinal channel 17 and/or that 16B of the first longitudinal channel 16 and/or that 8B of the interior space 8.

The middle barrel 15 may also be formed by several sections 19, for example welded or screwed together.

Figure 2:
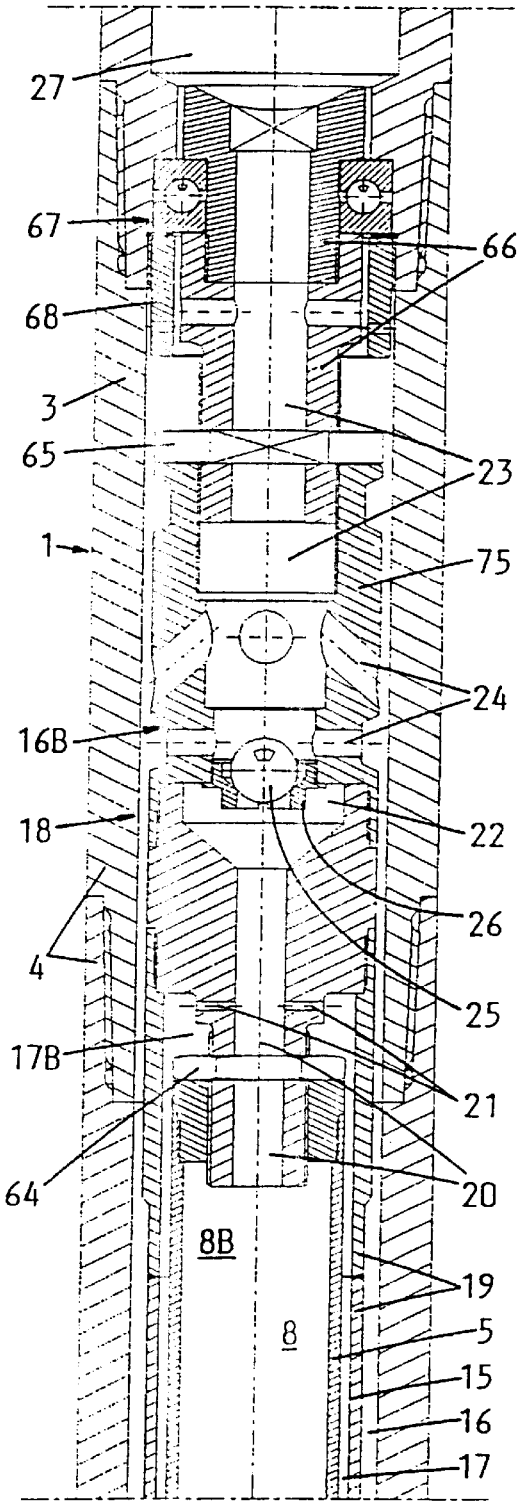
FIG. 2 depicts diagrammatically, in longitudinal section, with cutaway, the core sampler of FIG. 1, at the point of connection of the inner, middle and outer barrels and of the aforementioned selective blocking and producing means.

In the case of FIG. 2, the means 18 are arranged in such a way as to allow, in the case of a coring fluid, constant communication between the rear ends 8B and 17B, via ducts, for example an axial duct 20 and radial ducts 21.

A communication which may be controlled may be produced between these two rear ends 8B and 17B and the rear end 16B by the means 18, for example with the aid of the axial duct 20, a valve 22, an axial duct 23 and divergent and radial ducts 24. The valve 22 may be a ball 25 pressing onto an appropriate seat 26. The valve 22 may possibly comprise a spring (not depicted), adjustable or otherwise, to produce an effect of selectively regulating pressure between upstream and downstream of the valve 22.

In the embodiment of the invention depicted in FIG. 2, the selective means 18 are designed to at least temporarily place in fluid communication a duct 27 supplying a coring fluid from a reservoir (not depicted) on the surface and nozzles 28 (FIG. 1) of the bit 2, via the first longitudinal channel 16 and, for example, the axial duct 23 and the divergent and radial ducts 24.

The selective means 18 may be arranged, as is depicted in FIG. 2, to at least temporarily place in fluid communication the rear end 8B of the interior space 8 and the duct 27 for supplying coring fluid when the ball 25 is, for example, absent or off the valve seat 26 and, as appropriate, to selectively interrupt this fluid communication by placing the ball 25 on the valve seat 26. For example then, the ball 25 may be arranged so that it blocks a flow of fluid from the supply duct 27 toward the interior space 8, and so as possibly to allow flow in the opposite direction, if appropriate also toward the first longitudinal channel 16.

According to FIG. 1, the front end 17A of the second longitudinal channel 17 may be in coring-fluid communication with an annular gap 29 between a core sample 7 and the bit 2 and thereby with the bottom 31 of a hole during core-sampling.

For example, the core sampler 1 of FIGS. 1 and 2 may be used as follows.

The core sampler 1 of the invention is lowered in the usual way into a core-sampling hole, the ball 25 not yet being introduced into the core sampler 1 or, for example, not yet being released from a storage position (not depicted) provided in the core sampler 1. A coring fluid conveyed from a reservoir (not depicted) on the surface via the supply duct 27 is distributed, via the selective means 18,

- toward the first longitudinal channel 16, via the ducts 23 and 24 and from there toward the nozzles 28 of the bit 2 and the bottom 31 of the hole, so that the fluid therein fulfills its known function,
- toward the second longitudinal channel 17, via the ducts 23, 20 and 21, and from there toward the annular gap 29 and the bottom 31 of the hole, so that the coring fluid, for example, therein fulfills its known function and lubricates the core sample 7 as it enters the inner barrel 5, and
- toward the interior space 8 to clear the latter of debris which may have built up therein as the core sampler 1 was being lowered into the core-sampling hole, this debris then being expelled, for example, into the bottom 31 of the hole before the actual core-sampling operation proper is begun, and therein being ground up by the bit 2 so as to be removed in the usual way toward the surface by the coring fluid.

When it is judged that the interior space 8 is clear, the ball 25 is thrown into the supply duct 27 (or is released from its storage location) and, carried along by the coring fluid, it ends up on the valve seat 26 in order therein to block fluid communication from the supply duct 27 toward the interior space 8 and toward the second longitudinal channel 17. All the coring fluid from the supply duct 27 is then transmitted to the nozzles 28 via the first longitudinal channel 16. As a result of the blocking afforded by the ball 25, the top of the core sample 7 which is gradually entering the interior space 8 no longer experiences the pressure of the coring fluid as prevailing in the supply duct 27. To the contrary, the coring fluid that lies in the interior space 8 above the core sample 7 can be pushed back by the core sample 7 as the latter gradually enters this interior space 8 because this coring fluid can escape through the axial duct 20 and radial ducts 21 toward the second longitudinal channel 17 and from there toward the annular gap 29 and the bottom 31 of the hole where, as a function of known pressure drops in the core sampler 1, the coring fluid is usually at a lower pressure than the pressure that prevails in the supply duct 27. Thus, the core sample 7 is subjected throughout to a uniform pressure that is below that of the coring fluid in the supply duct 27 and is therefore subject to practically no compacting which could, in addition, make it rub excessively against the wall of the inner barrel 5, for example in the case of a not very consolidated material.

In cases where the coring fluid which has to escape from the interior space 8 toward the annular gap 29 finds itself blocked, for whatever reason, from the radial ducts 21, it can escape along the axial ducts 20 and 23 toward the first longitudinal channel 16, from the moment, for example, when its pressure overcomes the pressure applied to the ball 25 by the coring fluid in the supply duct 27. The aforementioned spring (not depicted) may be designed to modify the pressure threshold to be overcome.

Figure 4:
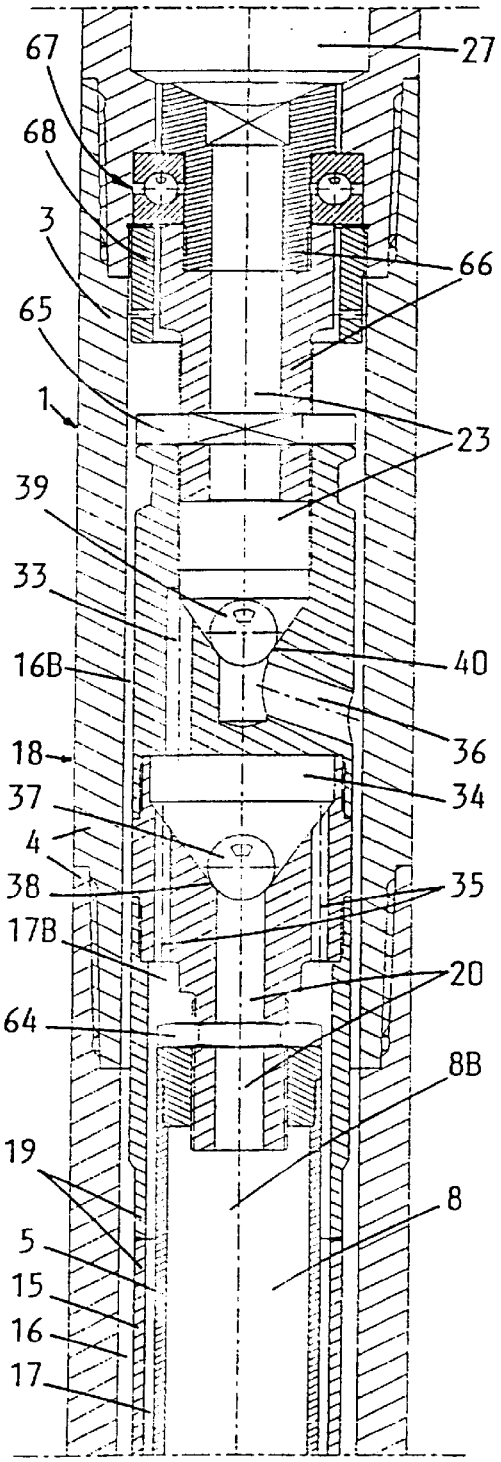
FIG. 4 depicts diagrammatically, in longitudinal section, with cutaway, the core sampler of FIG. 3 at the point of connection of the inner, middle and outer barrels and at that of the aforementioned selective blocking and producing means.

According to another embodiment of the invention, depicted in FIG. 4, the selective means 18 produce

- a direct and constant fluid communication between the supply duct 27 and the second longitudinal duct 17 via the axial duct 23, one or more off-axis ducts 33, an intermediate space 34 and one or more off axis ducts 35 opening into the rear end 17B of the second longitudinal channel 17,
- a fluid communication, which may be controlled, between the supply duct 27 and the first longitudinal channel 16, via the axial duct 23 and one or more oblique ducts 36, and
- a selective fluid communication in one direction which is from the interior space 8, on the one hand, toward the second longitudinal channel 17 via the intermediate space 34 and the off-axis duct or ducts 35 and, on the other hand, toward the supply duct 27 via the axial duct 23 and, as appropriate, toward the oblique duct 36 via the same axial duct 23.

For this, this other embodiment of the core sampler 1 then comprises valves,

- one of which may have the form of a ball 37 trapped in the intermediate space 34 of which it can close, via a valve seat 38, the inlet of the axial duct 20 toward the interior space 8 and
- the other of which may have the form of a ball 39 to be, for example, thrown into the supply duct 27 so as to close, via a valve seat 40, the start of the oblique duct or ducts 36 toward the rear end 16B of the first longitudinal channel 16.

Particularly in the case of this other embodiment, the core sampler 1 may have (FIG. 3) a restricted and possibly adjustable passage 42 between the front end 17A of the second longitudinal channel 17 and the aforementioned annular gap 29, for the coring-fluid communication at the bottom 31 of the core-sampling hole. In addition, near this front end 17A, the inner barrel 5 may, for example, have two coaxial circular walls 43, 44 delimiting an annular chamber 45 closed at its axially opposed ends 46, 47, for example, in each case, by a thickening of the wall 43 and by an O-ring seal between these two walls 43, 44, the innermost one, 43, of which is relatively thin with respect to the outermost one 44. The annular chamber 45 may be in fluid communication with the second longitudinal channel 17 via one or more radial passages 48.

Figure 3:
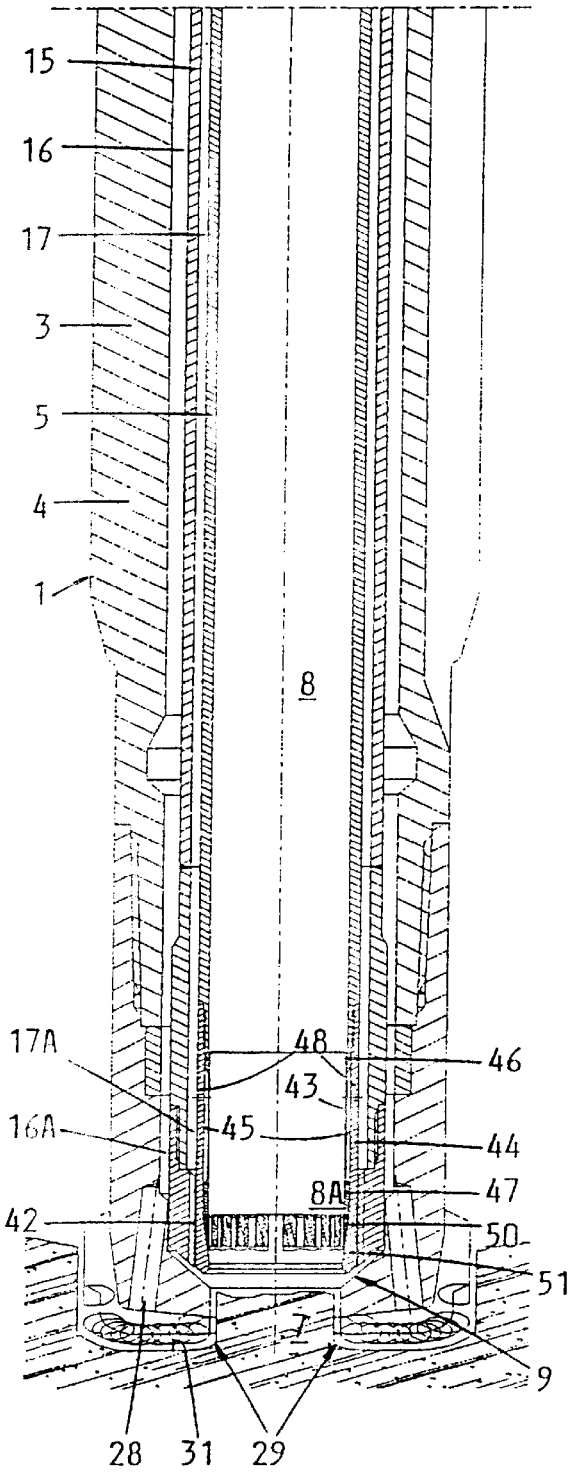
FIG. 3 depicts diagrammatically, in longitudinal section, with cutaway, a front end of a core sampler according to another embodiment of the invention.

This other embodiment of the core sampler 1 according to FIGS. 3 and 4 can be used as follows. At the beginning of and during a core-sampling operation, the ball 37 closes the valve seat 38 in such a way as to prevent direct flow of coring fluid from the supply duct 27 toward the rear end 8B of the interior space 8 and therefore into this space. However, coring fluid discharged toward the top of this interior space 8 by the core sample 7 can escape from this rear end 8B, as soon as its pressure overcomes the pressure experienced by the ball 37, and it can then flow into the intermediate space 34 and from there, for example, by the off-axis duct or ducts 35, toward the second longitudinal channel 17, and/or, via the off-axis ducts 33 and the axial duct 23, toward the supply duct 27 or rather toward the oblique duct or ducts 36 and then toward the first longitudinal channel 16 and the nozzles 28. Thus, on its top side, the core sample 7 does not experience a pressure higher than that of the coring fluid.

In addition, at the start of and during core-sampling, the coring fluid supplied by the supply duct 27 is conveyed,

- on the one hand, toward the first longitudinal channel 16 by the axial duct 23 and by the oblique duct or ducts 36, in the absence of the ball 39 on the valve seat 40, and from the first longitudinal channel 16 toward the bottom 31 of the hole via the nozzles 28, and
- on the other hand, by the off-axis ducts 33 and 35 and by the second longitudinal channel 17 toward said restricted passage 42 and toward the radial passages 48 via which the coring fluid transmits its pressure to the annular chamber 45.

At the moment it is chosen to withdraw the core sample 7 produced, the ball 39 is, for example, sent into the supply duct 27 and, carried along by the coring fluid, it ends up on the valve seat 40 so as to at least greatly reduce or even block the flow of coring fluid toward the oblique duct or ducts 36 and therefore toward the first longitudinal channel 16 and the nozzles 28 which need no longer be supplied at this moment, as core-sampling proper has finished. This blocking of the escape of coring fluid may lead, in a known way, to an appreciable increase in the pressure of the coring fluid, among other things in the second longitudinal channel 17 and therefore in the annular chamber 45, so as to obtain, toward the inside of the interior space 8, a deformation of the thin wall 43 which then clamps around the core sample 7 in order to hold it in this interior space 8 and remove it from the bottom 31 of the hole. To improve this clamping, the thin wall 43 may constitute a sleeve mounted to slide in the thick wall 44 and may have an external frustoconical part 50 pointing toward the front end of the core sampler 1, and equipped with at least one longitudinal cut and interacting with a corresponding internal frustoconical part 51, for example of the wall 44. Thus, the thin wall 43, already clamping the core sample 7 to a certain extent, can be driven toward this front end of the core sampler 1 and can thereby cause additional clamping of the external frustoconical part 50 against the core sample 7 by the action of the internal frustoconical part 51.

Figure 5:
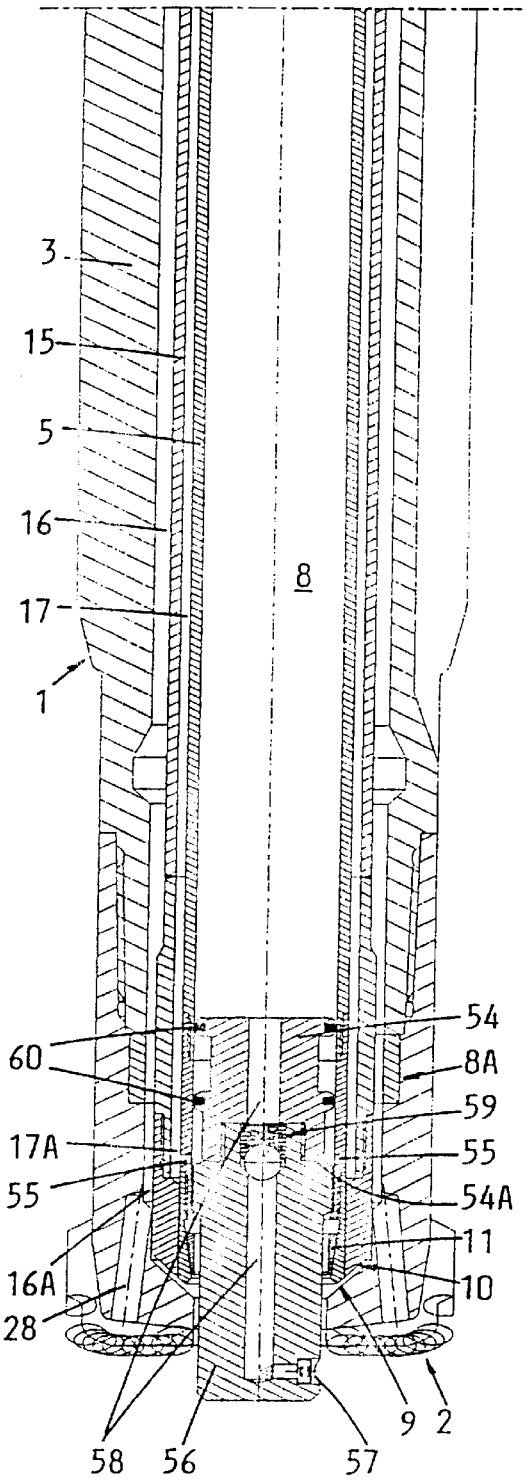
FIG. 5 depicts diagrammatically, in longitudinal section, with cutaway, a front end of a core sampler according to yet another embodiment of the invention, the core sampler being ready for a core-sampling operation.
Figure 6:
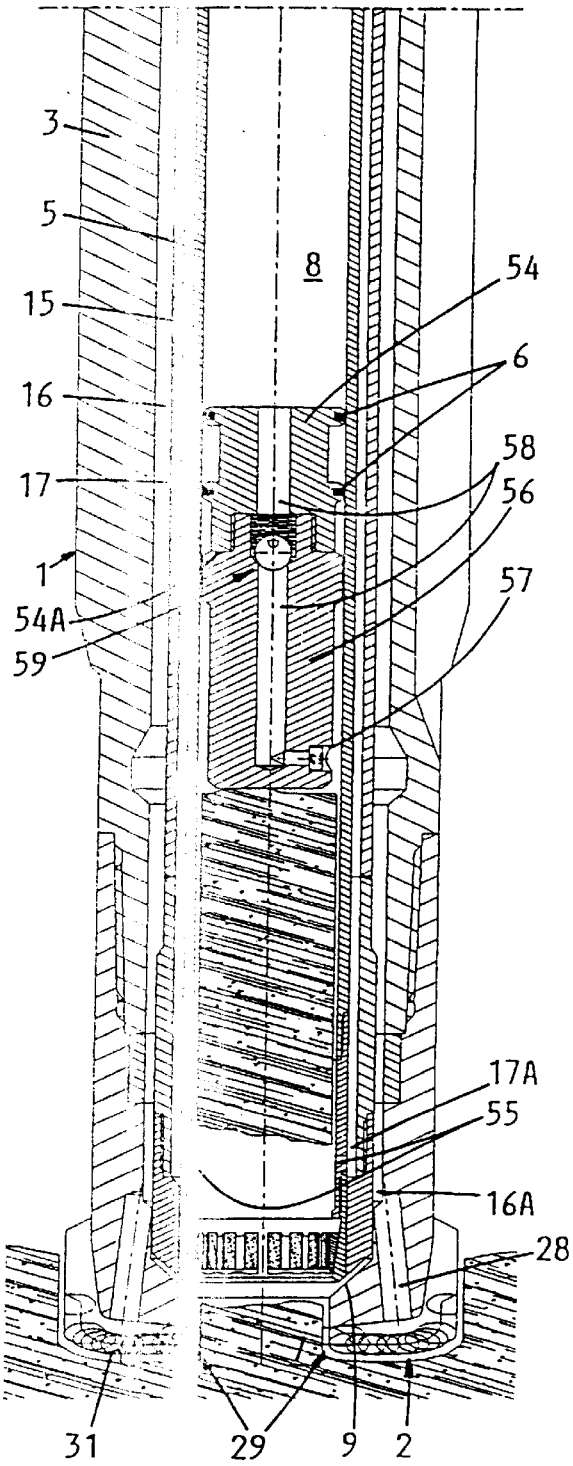
FIG. 6 is a depiction practially identical to that of FIG. 5, but the core sampler here is shown during a core-sampling operation.
Figure 7:
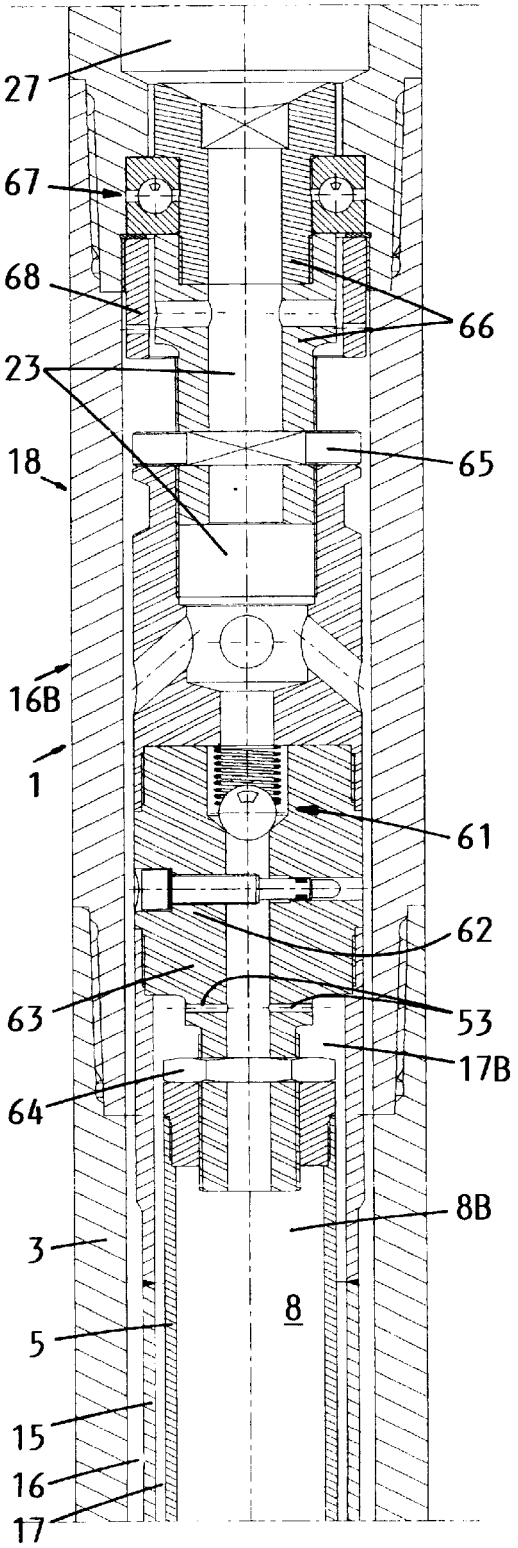
FIG. 7 depicts diagrammatically, in longitudinal section, with cutaway, the core sampler of FIGS. 5 and 6 at the point of connection of the inner, middle and outer barrels and at that of the aforementioned selective blocking and producing means.

In the case of a particular embodiment of the core sampler 1 of the invention, as depicted in FIGS. 5 to 7,

- the selective means 18 (FIG. 7) place in fluid communication, via their respective rear ends 8B and 17B, the interior space 8 and the second longitudinal channel 17, for example via one or more radial ducts 53,
- a piston 54 is mounted in the inner barrel 5 so that it can be pushed, by a core sample 7 as it is being formed, from practically the front end 8A of the interior space 8 toward the rear end 8B thereof, and
- a coring fluid may be housed in the interior space 8, at least between the piston 54 and the rear end 8B.

In this case, during core sampling, the piston 54 is pushed into the interior space 8 as the core sample 7 enters it. The coring fluid is driven from the interior space 8 by the piston 54 into the radical ducts 53 and from there into the second longitudinal channel 17 in order to escape somewhere above the base of the core sample 7 when the second longitudinal channel 17 comprises (as in the case of FIG. 1) a front end 17A that opens at the location of the front end 9 of the inner barrel 5, substantially around the perimeter thereof.

The particular embodiment of the core sampler 1 may, unlike in the case of FIG. 1, be arranged according to FIGS. 5 and 6, in which:

the front end 17A of the second longitudinal channel 17 is at least partially, and preferably completely, closed with respect to the annular gap 29, and radial passages 55 between the second longitudinal channel 17 and the interior space 8 are arranged close to their respective front ends 17A, 8A and open into the interior space 8 on the same side as the end 54A of the piston 54 that faces toward the core sample 7 even when the piston is in a starting position, as close as possible, for example, to the front end 9 of the inner barrel 5. The piston 54, possibly a plunger 56 explained hereinbelow, is arranged so that fluid leaving the passages 55 in this starting position can escape toward the bottom 31 of the hole. The passages 55 are preferably uniformly distributed about the longitudinal axis of the core sampler 1.

In the particular embodiment of the core sampler 1 depicted in FIGS. 5 and 6, there may be provided, on that end 54A of the piston 54 that faces toward the core sample 7, a plunger 56 designed to rest, at the beginning of a core-sampling operation, on the bottom 31 of the core-sampling hole and thereafter on the top of the core sample 7 during its formation. The plunger 56 may also be of one piece with the piston 54.

The piston 54 or, according to FIGS. 5 and 6, the plunger 56, comprises, at the point of its end that is intended to interact with the top of the core sample 7, a filling port 57 and, connected thereto, a duct 58 through the plunger 56 and/or the piston 54 as far as the interior space 8. A non-return valve 59 is advantageously installed in the duct 58 or at the point of the filling port 57.

To carry out core sampling using the core sampler 1 of FIGS. 5 to 7, the piston 54 is placed in the aforementioned starting position (FIG. 5). A coring fluid is injected through the filling port 57 and through the duct 58 into the interior space 8 and preferably until the fluid emerges from the radial channels 53 (FIG. 7) and flows toward the bottom of the core sampler 1 down the second longitudinal channel 17 (FIG. 5).

Actual core sampling proper is begun. The plunger 56, pushed by the bottom 31 of the hole and thereafter by the core sample 7 which enters the core sampler 1, pushes the piston 54 into the interior space 8. The coring fluid driven toward the top of this interior space 8 escapes through the radial ducts 53 toward the second longitudinal channel 17 and from the latter via the passages 55 from which the coring fluid spreads out into an annular gap between the wall of the inner barrel 5 and the core sample 7 in order to cover the latter as it enters the interior space 8.

As FIG. 5 shows, in the starting position, the plunger 56 advantageously protrudes from the core sampler 1 so as to give access to the filling port 57 arranged on the side.

The piston 54 may comprise O-ring seals 60 interacting with the wall of the inner barrel 5, if it is desired to prevent direct flows of fluid from the interior space 8 toward the top of the core sample 7.

In the case of the particular embodiment according to FIGS. 5 to 8, the coring fluid injected into the interior space 8 may be different than the one coming from the aforementioned reservoir via the supply duct 27. The different fluid may be a fluid for protecting the core sample 7 or a fluid capable of lubricating the sliding of the core sample 7 in the inner barrel 5, known to those skilled in the art.

According to the invention, the radial ducts 21 (FIG. 2) and/or 53 (FIG. 7) may constitute a restricted passage for the coring fluid which runs from the interior space 8 toward the second longitudinal channel 17. Adjusting means known to those skilled in the art (spring-loaded valve, etc.) may be added to these ducts in order to be able to adjust their passage, for example so as to subject the core sample 7 to a chosen pressure which helps retain the stability of its structure.

A safety valve 61 (FIG. 7) and/or a pressure-dumping means such as a screw 62 may be arranged so as to allow the escape, for example from the interior space 8 and/or from the second longitudinal channel 17, of the fluid which is pressurized therein as a result of the core sample 7 being driven into this interior space 8 and which fluid is held under pressure as a result of a blocking of the ducts provided for discharging this pressure. For example, the safety valve 61 may act during core sampling and allow the escape, if need be, of the fluid from the interior space 8 toward the first longitudinal channel 16. For example also, after core-sampling and before the core sample 7 is released from the system 10 with the split frustoconical ring 11, it is possible to unscrew the set screw 62 in order to ensure that there is no longer within the interior space 8 a pressure which could dangerously expel the core sample 7 therefrom.

FIGS. 2, 4 and 7 each show one arrangement of the three, inner 5, middle 15 and outer 3, barrels, in which:

the inner barrel 5 and middle barrel 15 are joined together, for example, by a first connector 63 which, using a known axial-adjustment system comprising screw, threaded hole and lock nut 64, on the one hand allows axial adjustment of the inner barrel 5 and middle barrel 15 with respect to each other and, on the other hand, allows these barrels to be locked with respect to one another as far as rotation about their common longitudinal axis is concerned, the first connection 63 is for example fixed by another known axial-adjustment system comprising screw, threaded hole and lock nut 65, to a hub 66 (made in two parts) of a thrust ball bearing 67 held between the outer barrel 3 and a nut 68.

Thus, the inner barrel 5 and the middle barrel 15 may, together, rotate or not about their common longitudinal axis, independently of any rotation of the outer barrel 3.

Figure 8:
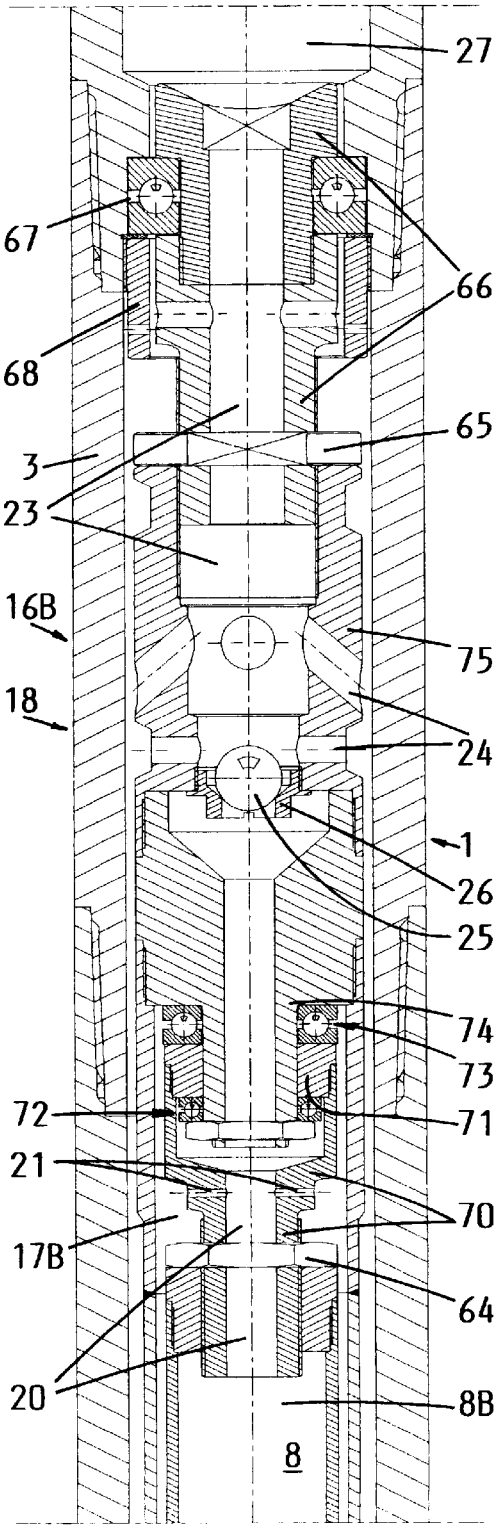
FIG. 8 depicts diagrammatically, in longitudinal section, with cutaway, a form of connection between the inner and middle barrels of the core sampler according to the invention which is other than the form of the connection of FIG. 2.

FIG. 8 shows an embodiment in which the inner barrel 5, the middle barrel 15 and the outer barrel 3 can rotate independently of one another about their common longitudinal axis. For this, a screw 70 fixed in a threaded hole at the rear end of the inner barrel 5 is mounted on a ring 71 arranged between two thrust ball bearings 72, 73 which are mounted on a shaft 74 itself carried by an appropriate connection 75 which for its part is mounted in the outer barrel 3 as is the connector 63 in FIG. 7.

An assembly similar to that of FIG. 8 but without the thrust ball bearings 67 may also be used in cases where it is desired for the middle barrel 15 and outer barrel 3 to be fixed together as far as their rotation about their common longitudinal axis is concerned and for the inner barrel 5 to be able to rotate or remain stationary about the common longitudinal axis independently of the middle barrel 15 and outer barrel 3.

It must be understood that the invention is not in any way restricted to the embodiments described and that many modifications may be made to the latter without departing from the scope of the present invention.

Thus, the ducts said to be radial, axial, off-axis, oblique, may be oriented and arranged differently than in the drawings.

Figure 9:
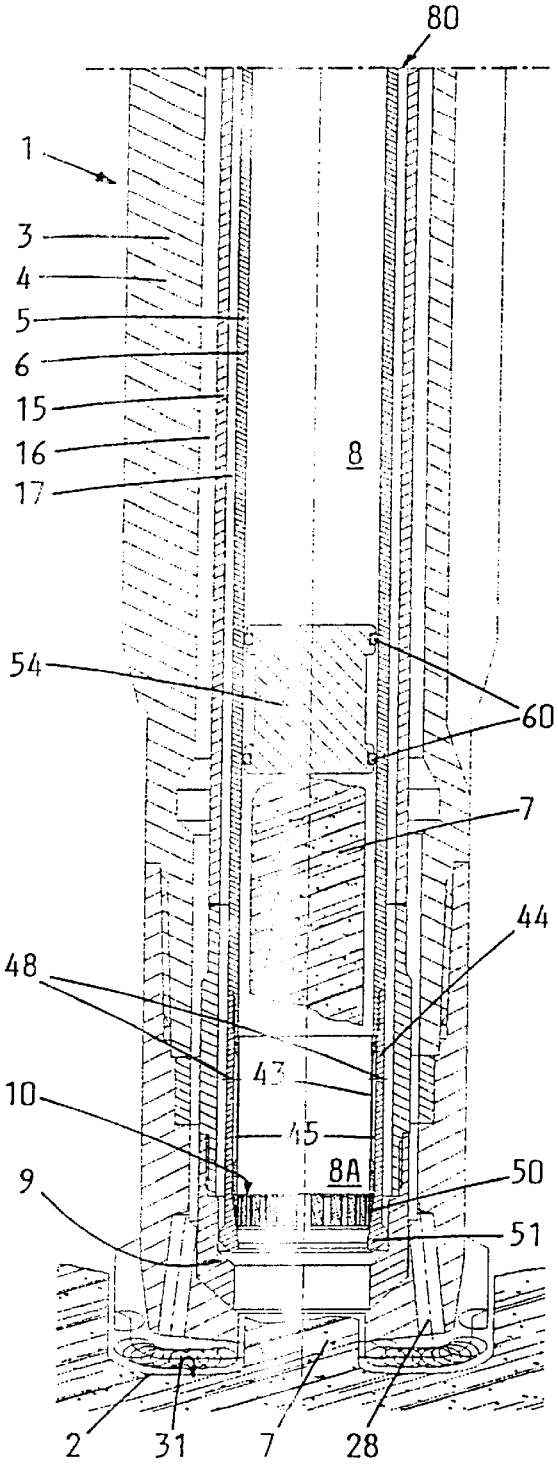
FIG. 9 depicts diagrammatically, in longitudinal section, with cutaway, a front end of a core sampler according to a particular embodiment of the invention, in which embodiment the middle and inner barrels form a constituent assembly that can move in the outer barrel.
Figure 10:
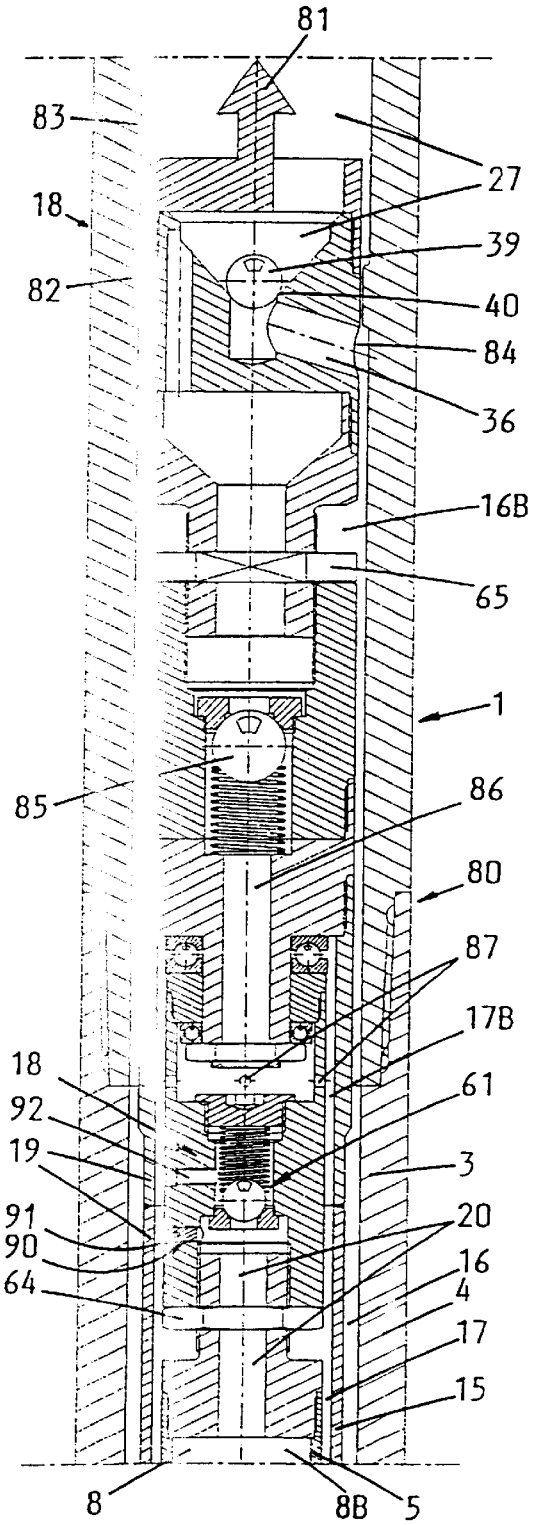
FIG. 10 depicts diagrammatically, in longitudinal section, with cutaway, the point of connection of the middle and inner barrels of the core sampler of FIG. 9.

For example also, as shown in FIG. 10, the inner barrel 5 and middle barrel 15 are fixed together by two thrust ball bearings to form a constituent assembly 80 and so as to be able to rotate independently of one another about their common longitudinal axis. The constituent assembly 80 is arranged in the outer barrel 3 in such a way that it can slide therein between:

a core-sampling position depicted in FIGS. 9 and 10, in which the middle barrel 15 is in abutment in the bit 2, as depicted, or possibly (and this is not depicted) against the outer barrel 3 and a position with the outer tube 3 withdrawn so that the core sample 7 produced can be withdrawn.

The constituent assembly 80 comprises known attachment means 81 at its end furthest from the front end 9 of the inner barrel 5. A core sampler 1 of the type depicted in FIGS. 9 and 10 may form part of the so-called wire line type. During normal core sampling, the constituent assembly 80 is kept in the abutment position by means of the pressure of the coring fluid applied to its exposed surfaces.

The selective means 18 of the core sampler 1 of FIG. 10 comprise an annular box 82 arranged on the interior wall 83 of the outer barrel 3 and at least one outlet port 84, such as that of the oblique duct 36, opening into the first longitudinal channel 16. In the core-sampling position, the constituent assembly 80 in abutment at the front end in the outer tube 3, the annular boss 82 is outside of a flow of liquid from the outlet port 84 into the first longitudinal channel 16. The constituent assembly 80 can move away from the abutment position, for example because it remains blocked at a certain level of the core sample 7 even though the bit 2 continues to make progress. Such a blockage may be the result of the inner barrel 5 becoming jammed around the core sample 7 or of the liquid that has built up between the core sample 7 and the bottom of the inner barrel 5 not being able to escape. According to the invention, as the constituent assembly 8 thus progressively moves away from its abutment position, the annular boss 82 and the outlet port 84 progressively come to face one another so as to restrict to the desired extent the flow of liquid from the outlet orifice 84 toward the longitudinal channel 16. This restriction of flow may be practically total or at least sufficient to lead to an increase in coring-fluid pressure, it being possible for this increase to be interpreted as a signal that the penetration of the core sample 7 into the inner barrel 5 has become locked.

In the core-sampling position (FIG. 9), the middle barrel 15 may bear in leaktight fashion, at the same end as the front end 16A, against a bearing surface of the bit 2 or possibly of the outer barrel 3, so as therein to close the first longitudinal channel 16.

FIG. 9 shows, without implied limitation, the core sampler 1 in a case with a thin 43 and a thick 44 circular wall which are coaxial. In this case, a valve 85 makes it possible, by adjusting its spring, to choose the fluid pressure beyond which this fluid can pass from the supply duct 27 toward the second longitudinal channel 17, via a coaxial duct 86 and radial ducts 87, so as to deform the thin wall 43 in the way explained above.

A small passage of fluid between the inner barrel 5 and middle barrel 15 of FIG. 9, at their front end, may be desired.

In order to prepare the core sampler 1 of FIG. 10 and possibly with a view to taking a core sample and, for example, in order to fill the inner barrel with a fluid for protecting and/or lubricating the core sample 7, an inlet 90 may be provided for injecting either this fluid or compressed air in order to push the piston 54 into the starting position. For this operation, a plug 91 is removed from this inlet 90 and placed in an outlet 92 to prevent losses via the valve 61. After this operation, the plug 91 is removed from the outlet 92 and placed back in the inlet 90 to prevent uncontrolled leakage via the valve 61 of the fluid that lies in the inner barrel 5. After a core-sampling operation, the plug 91 can be moved again from the inlet 90 to the outlet 92 and an appropriate fluid (compressed air, etc.) can be injected in order to push the piston 54 and thus drive out a core sample 7 housed in the inner barrel 5, for example having removed (FIG. 9) a section of the latter which comprises the thin wall 43, if the latter is in use.

What is claimed is:

1. Core sampler, particularly for oil prospecting, comprising:

coring bit (2), an outer barrel (3) for rotating the coring bit (2), and an inner barrel (5) for receiving a core sample (7) in an interior space (8) during core sampling, the inner barrel (5) and outer barrel (3) being substantially coaxial, characterized in that the core sampler additionally comprises:

a middle barrel (15) arranged coaxially between the inner barrel (5) and the outer barrel (3) delimiting, on the one hand with the outer barrel (3), a first longitudinal channel (16) for core sampling fluid and, on the other hand, with the inner barrel (5), a second longitudinal channel (17) for core sampling fluid, the longitudinal channels (16, 17) and the interior space (8) each having a front end (16A, 17A, 8A) close to the coring bit (2) and a rear end (16B, 17B, 8B) remote from this bit (2), a valve (18) which can be selectively opened or closed, and which at least temporarily, provides, when open, or blocks, when closed, coring fluid communication between the rear end (17B) of the second longitudinal channel (17) and/or that (16B) of the first longitudinal channel (16) and/or that (8B) of the interior space (8) whereby when the valve is open, core sampling fluid may flow through the valve from the rear end (8B) toward the front end (8A) of the interior space (8), and whereby core sampling fluid displaced from the interior space (8) when the valve (18) is closed flows from the second channel (17) to the front end (8A) of the interior space before flowing away from the bit (2).

2. Core sampler according to claim 1, characterized in that the aforementioned valve (18) at least temporarily places in fluid communication a supply duct (27) for supplying coring fluid from a reservoir on the surface to nozzles (28) of the bit (2), via the first longitudinal channel (16).

3. Core sampler according to claim 2, characterized in that the valve (18) at least temporarily places in fluid communication the rear end (8B) of the aforementioned interior space (8) and the supply duct (27) for supplying coring fluid.

4. Core sampler according to either of claim 2 or 3, characterized in that the front end (17A) of the second longitudinal channel (17) is in fluid communication with an annular gap (29) between the core sample (7) and the bit (2), and thereby with a bottom (31) of a hole during a core sampling operation.

5. Core sampler according to claim 3, characterized in that the valve (18) comprises a controlled valve (22) designed to selectively block a flow of fluid from the supply duct (27) toward the interior space (8) and so as possibly to allow a flow from this interior space toward the supply duct (27), if appropriate toward the first longitudinal channel (16).

6. Core sampler according to claim 5, characterized in that the valve (18) at least temporarily provides a fluid communication between the supply duct (27) and the second longitudinal channel (17), and further comprising an auxiliary controlled valve (39) designed to selectively block a flow of fluid from the supply duct (27) toward the first longitudinal channel (16).

7. Core sampler according to claim 6, characterized in that a restricted passage (42), possibly adjustable, is contrived between the front end (17A) of the second longitudinal channel (17) and an annular gap (29) between the core sample (7) and the bit (2).

8. Core sampler according to either of claim 1 or 2, characterized in that a piston (54) is mounted in the inner barrel (5) so that the piston can be pushed, from practically the front end of the interior space (8) toward the rear end (8B) of the interior space, by a core sample (7) which is being formed, and coring fluid is housed in the inner barrel (5), at least between the piston (54) and the rear end (8B) of the interior space (8).

9. Core sampler according to claim 8, characterized in that the front end (17A) of the second longitudinal channel (17) is at least partially closed with respect to an annular gap (29) between the bit (2) and the core sample (7).

10. Core sampler according to claim 8 further comprising a plunger (56) and a filling port (57) so that core sampling fluid can be injected through the filling port (57) at least into part of the interior space (8) prior to core sampling.

11. Core sampler according to claim 8 characterized in that the coring fluid housed in the inner barrel (5) is different than the coring fluid in the supply duct (27).

12. Core sampler according to claim 1 characterized in that the value (18) comprises, for fluid communication between the rear end (8B) of the interior space (8) and that (17B) of the second longitudinal channel (17) a restricted passage.

13. Core sampler according to claim 1 characterized in that said core sampler includes a means of dumping pressure.

14. Core sampler according to claim 1 characterized in that the outer barrel (3) and the middle barrel (15) are mounted to rotate independently of one another about their common longitudinal axis and in that the inner barrel (5) is mounted unable to move, at least in terms of rotation, with respect to the middle barrel (15).

15. Core sampler according to claim 1 characterized in that the outer barrel (3) and the middle barrel (15) are mounted stationary with respect to one another, at least as far as rotation about a common longitudinal axis is concerned, and in that the middle barrel (15) and the inner barrel (5) are mounted to rotate independently of one another about a common longitudinal axis.

16. Core sampler according to claim 1 characterized in that the inner barrel (5) and the middle barrel (15) are fixed together in the form of a constituent assembly (80), so that the inner barrel (5) and the middle barrel (15) can rotate independently of one another about a common longitudinal axis, and in that the constituent assembly (80) thus formed is arranged so that it can slide in the outer barrel (3) between a core sampling position and a withdrawn position of the outer barrel (3) so that the core sample (7) can be withdrawn therefrom.

17. Core sampler according to claim 16 characterized in that the valve (18) comprises an annular boss (82) on the interior wall (83) of the outer barrel (3) and at least one outlet port (84) opening into the first longitudinal channel (16), and in that, when the constituent assembly (80) is in the core sampling position in abutment in the outer barrel (3), the annular boss (82) lies outside a flow of fluid from the outlet port (84) into the first longitudinal channel (16).

18. Core sampler according to either of claim 15 or 16, characterized in that, in the core sampling position, the middle barrel (15) rests in a sealed fashion against a bearing surface to close the first longitudinal channel (16).

19. Core sampler, particularly for oil prospecting, comprising:

a coring bit (2), an outer barrel (3) for rotating the coring bit (2), an inner barrel (5) for receiving a core sample (7) in its interior space (8) during core sampling, the inner barrel (5) and outer barrel (3) being substantially coaxial, a middle barrel (15) arranged coaxially between the inner barrel (5) and the outer barrel (3) delimiting, on the one hand with the outer barrel (3), a first longitudinal channel (16) for a first core sampling fluid and, on the other hand, with the inner barrel (5), a second longitudinal channel (17) for the first core sampling fluid, the longitudinal channels (16, 17) and the interior space (8) each having a front end (16A, 17A, 8A) close to the coring bit (20 and a rear end (16B, 17B, 8B) remote from the bit (2), a supply duct (27) for supplying the first coring fluid from a reservoir on the surface to the core sampler (1), a valve (18) arranged to selectively place in fluid communication, on one hand, by their rear ends (8B, 17B) the interior space (8) and the second longitudinal channel (17),and on the other hand, the supply duct (27) and nozzles (28) of the bit (2) via the first longitudinal channel (16), and a piston (54) mounted in the inner barrel (5) so that the piston (54) can be pushed, from practically the front end (8A) toward the rear end (8B) of the interior space (8), by a core sample (7) that enters in the interior space (8), and wherein the interior space (8) of the inner barrel (5) is adapted to contain, before the core sampling as such and at least in the beginning of the core sampling operation, a second coring fluid, at least between the piston (54) and the rear end (8B) of the inner barrel (5), characterized in that the front end (17A) of the second longitudinal channel (17) is arranged so that the second coring fluid escapes the second channel (17) adjacent the core sample (7).

20. Core sampler according to claim 19, characterized in that, the front end (17A) of the second channel (17) is at least partially open towards the front end (9) of the inner barrel (5).

21. Core sampler according to claim 19, characterized in that the front end (17A) of the second longitudinal channel (17) is at least partially closed with respect to an annular gap (29) between the bit (2) and the core sample (7).

22. Core sampler according to any one of claims 19 to 21, charaterized in that the valve (18) at least temporarily places in fluid communication the rear end (8B) of the interior space (8) and the duct (27) for supplying coring fluid.

23. Core sampler according to either of claims 19 to 21, characterized in that the valve (18) comprises a controlled valve (22) designed to selectively block a flow of fluid from the supply duct (27) toward the interior space (8) and so as possibly to allow a flow from this space toward the supply duct (27), if appropriate toward the first longitudinal channel (16).

24. Core sampler according to any one of claims 19 to 21, characterized in that the valve (18) at least temporarily provides a fluid communication between the supply duct

(27) and the second longitudinal channel (17), and further comprising an auxiliary controlled valve (39) designed to selectively block a flow of fluid from the supply duct (27) toward the first longitudinal channel (16).

25. Core sampler according to claim 19, characterized in that a restricted passage (42) is contrived for fluid communication between the front end (17A) of the second longitudinal channel (17) and an annular gap (29).

26. Core sampler according to any one of claims 19 to 21 further comprising a plunger (56) which is arranged on that end (54A) of the piston (54) which faces toward the core sample (7), so as to rest on the bottom (31) of a coring hole and then on the top of the core sample (7) as the core sample is being formed, and in that the piston (54), or the plunger (56), comprises, at that point on its end that is intended to interact with the top of the core sample (7), a filling port (57) connected to a duct (58) through the plunger (56) and/or the piston (54), so that core sampling fluid can be injected through the port (57) and the duct (58) at least into part of the interior space (8) prior to core sampling, when the piston (54) is practically at the point of the front end (8A) of the interior space (8).

27. Core sampler according to any one of the claims 19 to 21 characterized in that the coring fluid housed in the inner barrel (5) and possibly in the second longitudinal channel (17) is different than the coring fluid in the supply duct (27) and in the first longitudinal channel (16), and is preferably a lubricating fluid.

28. Core sampler according to any one of claims 19 to 21 characterized in that the valve (18) comprises, for fluid communication between the rear end (8B) of the interior space (8) and that (17B) of the second longitudinal channel (17), a restricted passage.

29. Core sampler according to any one of claims 19 to 21 further comprising for the interior space (8) and/or for the second longitudinal channel (17), a safety valve (61) for dumping pressure.

30. Core sampler according to any one of claims 19 to 21 characterized in that the outer barrel (3) and the middle barrel (15) are rotatable independently of one another about a common longitudinal axis and in that the inner barrel (5) is fixed, at least in terms of rotation, with respect to the middle barrel (15).

31. Core sampler according to any one of claims 19 to 21 characterized in that the outer barrel (3) and the middle barrel (15) are fixed with respect to one another, at least as far as rotation about a common longitudinal axis is concerned, and in that the middle barrel (15) and the inner barrel (5) are rotatable independently of one another about a common longitudinal axis.

32. Core sampler according to any one of claims 19 to 21 characterized in that the inner barrel (5) and the middle barrel (15) are fixed together in the form of a constituent assembly (80), so that the inner barrel (5) and the middle barrel (15) are rotatable independently of one another about a common longitudinal axis, and in that the constituent assembly (80) is arranged in the outer barrel (3) so that the constituent assembly can slide in the outer barrel (3) between a core sampling position and a withdrawn position of the outer barrel (3).

33. Core sampler according to claim 32 characterized in that the valve (18) comprises an annular boss (82) on the interior wall (83) of the outer barrel (3) and at least one outlet port (84) including an oblique duct (36) opening into the first longitudinal channel (16), and in that, when the constituent assembly (80) is in the core sampling position, the annular boss (82) lies outside a flow of fluid from the outlet duct (84) into the first longitudinal channel (16) and, as the constituent assembly (80) moves away from the core sampling position, the annular boss (82) and the outlet port (84) gradually become closer together and face each other so as to restrict the flow of liquid from the outlet duct (84) toward the longitudinal channel (16).

34. Core sampler according to either of claim 31, characterized in that, in the core sampling position, on the same side as the front end (16A), the middle barrel (15) rests in a sealed fashion against a bearing surface of the bit (2) or of the outer barrel (3) in order therein to close the first longitudinal channel (16).

35. Core sampler, particularly for oil prospecting, comprising:

a coring bit (2), an outer barrel (3) for rotating the coring bit (2), and an inner barrel (5) for receiving a core sample (7) in its interior space (8) during core sampling, the inner barrel (5) and outer barrel (3) being substantially coaxial characterized in that it additionally comprises:

a middle barrel (15) arranged coaxially between the inner barrel (5) and the outer barrel (3) delimiting, on the one hand with the outer barrel (3), a first longitudinal channel (16) for core sampling fluid and, on the other hand, with the inner barrel (5), a second longitudinal channel (17) for core sampling fluid, the longitudinal channels (16, 17) and the interior space (8) each having a front end (16A, 17A, 8A) close to the coring bit (2) and a rear end (16B, 17B, 8B) remote from this bit (2), and selective means (18) which selectively, and at least temporarily, provide and/or block coring fluid communication between the rear end (17B) of the second longitudinal channel 17) and/or that (16B) of the first longitudinal channel (16) and/or that (8B) of the interior space (8), said core sampler further characterized in that the aforementioned selective means (8) at least temporarily place in fluid communication a duct (27) for supplying coring fluid from a reservoir on the surface to nozzles (28) of the bit (2), via the first longitudinal channel (16), said core sampler further characterized in that the selective means (18) at least temporarily place in fluid communication the rear end (8B) of the aforementioned interior space (8) and the duct (27) for supplying coring fluid, said core sampler further characterized in that the selective means (18) comprise a controlled valve (22) designed to selectively block a flow of fluid from the supply duct (27) toward the interior space (8) and so as possibly to allow a flow from this interior space toward the supply duct (27), if appropriate toward the first longitudinal channel (16), said core sampler further characterized in that the selective means (18) at least temporarily provide a fluid communication between the supply duct (27) and the second longitudinal channel (17), and comprise an auxiliary controlled valve (39) designed to selectively block a flow of fluid from the supply duct (27) toward the first longitudinal channel (16).

36. Core sampler according to claim 35, characterized in that a restricted passage (42), possibly adjustable, is contrived between the front end (17A) of the second longitudinal channel (17) and an annular gap (29) between the core sample (7) and the bit (2) for fluid communication between these.

37. Core sampler, particularly for oil prospecting, comprising:

coring bit (2), an outer barrel (3) for rotating the coring bit (2), and an inner barrel (5) for receiving a core sample (7) in its interior space (8) during core sampling, the inner barrel (5) and outer barrel (3) being substantially coaxial, characterized in that it additionally comprises:

a middle barrel (15) arranged coaxially between the inner barrel (5) and the outer barrel (3) and delimiting, on the one hand with the outer barrel (3), a first longitudinal channel (16) for core sampling fluid and, on the other hand, with the inner barrel (5), a second longitudinal channel (17) for core sampling fluid, the longitudinal channels (16, 17) and the interior space (8) each having a front end (16A, 17A, 8A) close to the coring bit (2), and means (18) which selectively, and at least temporarily, provide and/or block coring fluid communication between the rear end (17B) of the second longitudinal channel (17) and/or that (16B) of the first longitudinal channel (16) and/or that (8B) of the interior space (8), said core sampler further characterized in that the outer barrel (3) and the middle barrel (15) are mounted in such a way that they can rotate independently of one another about their common longitudinal axis and in that the inner barrel (5) is mounted so that it is unable to move, at least in terms of rotation, with respect to the middle barrel (15).

38. Core sampler, particularly for oil prospecting, comprising:

a coring bit (2), an outer barrel (3) for rotating the coring bit (2), and an inner barrel (5) for receiving a core sample (7) in its interior space (8) during core sampling, the inner barrel (5) and outer barrel (3) being substantially coaxial characterized in that it additionally comprises:

a middle barrel (15) arranged coaxially between the inner barrel (5) and the outer barrel (3) and delimiting, on the one hand with the outer barrel (3), a first longitudinal channel (16) for core sampling fluid and, on the other hand, with the inner barrel (5), a second longitudinal channel (17) for core sampling fluid, the longitudinal channels (16, 17) and the interior space (8) each having a front end (16A, 17A, 8A) close to the coring bit (2) and a rear end (16B, 17B, 8B) remote from this bit (2), and means (18) which selectively, and at least temporarily, provide and/or block coring fluid communication between the rear end (17B) of the second longitudinal channel (17) and/or that (16B) of the first longitudinal channel (16) and/or that (8B) of the interior space (8), said core sampler further characterized in that the inner barrel (5) and the middle barrel (15) are fixed together in the form of a constituent assembly (80), so that they can rotate independently of one another about their common longitudinal axis, and in that the constituent assembly (80) thus formed is arranged in the outer barrel (3) so that it can slide therein between a core sampling position, in which the middle barrel (15) is practically in abutment in the coring bit (2), and a withdrawn position of the outer barrel (3) so that the core sample (7) can be withdrawn therefrom, the constituent assembly (80) comprising attachment means (81) arranged at its end furthest from the front end (9) of the inner barrel (5).

39. Core sampler according to claim 38 characterized in that the selective means (18) comprise an annular boss (82) on the interior wall (83) of the outer barrel (3) and at least one outlet port (84), such as that of an oblique duct (36) opening into the first longitudinal channel (16), and in that, when the constituent assembly (80) is in the core sampling position in abutment in the outer barrel (3), the annular boss (82) lies outside a flow of fluid from the outlet port (84) into the first longitudinal channel (16) and, as the constituent assembly (80) moves away from the abutment position, the annular boss (82) and the outlet port (84) gradually become closer together until they lie one facing the other so as to restrict the flow of liquid from the outlet duct (84) toward the longitudinal channel (16).

* * * * *

UNITED STATES PATENT AND TRADEMARK OFFICE

CERTIFICATE OF CORRECTION

PATENT NO : 6,158,534

DATED : December 12, 2000

INVENTOR(S) : Philippe Fanuel

It is certified that error appears in the above-identified patent and that said Letters Patent is hereby corrected as shown below:

In column 10, line 51, delete "claim" and insert therefor --claims--.

In column 11, line 30, delete "value" and insert therefor --valve--.

In column 12, line 20, delete "(20" and insert therefor --(2)--.

In column 12, line 55, delete "charaterized" and insert therefor --characterized--.

In column 12, line 58, delete "either" and insert therefor --any one--.

In column 14, line 7, delete "either of".

In column 14, line 35, delete "17)" and insert therefor --(17)--.

In column 14, line 38, delete "(8)" and insert therefor --(18)--.

In column 15, line 1, before "coring", insert --a--.

Signed and Sealed this

First Day of May, 2001

*Attest:*

Nicholas P. Godici

NICHOLAS P. GODICI

*Attesting Officer*

*Acting Director of the United States Patent and Trademark Office*